US008408943B2

(12) United States Patent
Okamoto

(10) Patent No.: US 8,408,943 B2
(45) Date of Patent: Apr. 2, 2013

(54) CONNECTOR

(75) Inventor: Kenichi Okamoto, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/293,447

(22) Filed: Nov. 10, 2011

(65) Prior Publication Data

US 2012/0122341 A1 May 17, 2012

(30) Foreign Application Priority Data

Nov. 11, 2010 (JP) ..... P2010-252594

(51) Int. Cl.
*H01R 9/03* (2006.01)

(52) U.S. Cl. ..... 439/607.55; 439/607.41

(58) Field of Classification Search ..... 439/607.01, 439/607.41, 607.52, 607.54, 607.55
See application file for complete search history.

(56) References Cited

U.S. PATENT DOCUMENTS

| | | | | |
|---|---|---|---|---|
| 8,113,876 | B1 * | 2/2012 | Rossman et al. | 439/578 |
| 8,157,594 | B2 * | 4/2012 | Gilliam | 439/607.41 |
| 8,167,653 | B2 * | 5/2012 | Hasegawa et al. | 439/607.41 |
| 2009/0130903 | A1 | 5/2009 | Tsukashima et al. | |

FOREIGN PATENT DOCUMENTS

| | | |
|---|---|---|
| JP | 2006-344398 | 12/2006 |
| JP | 2008-235189 | 10/2008 |

* cited by examiner

*Primary Examiner* — Khiem Nguyen
(74) *Attorney, Agent, or Firm* — Finnegan, Henderson, Farabow, Garrett & Dunner, L.L.P.

(57) ABSTRACT

A connector includes a first assembly structure and a second assembly structure assembled together. The first assembly structure includes: a connector housing from which an electric wire is pulled out; a first shield shell fixed to the connector housing; and a first locking portion provided on any one of the connector housing and the first shield shell. The second assembly structure includes: a second shield shell having a guide configured to make pressure contact with a connection plate of the first shield shell in an assembled state; a second locking portion engaging with the first locking portion in the assembled state; a shield electric wire covering the electric wire; and an electric wire fastener fastening the shield electric wire to the second shield shell with the shield electric wire interposed between the electric wire fastener and the second shield shell.

3 Claims, 7 Drawing Sheets

CONNECTOR

CROSS REFERENCE TO RELATED APPLICATION

This application is based upon and claims the benefit of priority from the prior Japanese Patent Application No. 2010-252594, filed on Nov. 11, 2010, the entire contents of which are incorporated herein by reference.

BACKGROUND OF THE INVENTION

1. Field of the Invention

The present invention relates to a connector with shielding function.

2. Description of the Related Art

High voltage and high current are applied to wire harnesses used as wirings for drive of motors for HEVs (Hybrid Electric Vehicles) and EVs (Electric Vehicles). For this reason, connectors of such wire harnesses have shielding function. Japanese Unexamined Patent Application Publication Nos. 2008-235189 (hereinafter referred to as a first related art) and 2006-344398 (hereinafter referred to as a second related art) disclose this kind of related connectors.

As illustrated in FIG. 1, a connector 100 of the first related art includes: a connector housing 101 from which an electric wire W connected to a terminal 110 is pulled out; a shield shell 102 fix to the outer periphery of the connector housing 101; a shield electric wire 103 disposed so as to cover the outer periphery of the electric wire W; a pair of holders 104*a*, 104*b* disposed so as to cover, from outside, the end region of the shield electric wire 103 disposed on the shield shell 102; and two pairs of bolts 105 and nuts 106 fastening the pair of holders 104*a*, 104*b* together.

The assembling of the connector 100 of the first related art is performed in the following way. The end region of the shield electric wire 103 is disposed on the outer periphery of the shield shell 102, the pair of holders 104*a*, 104*b* are disposed so as to sandwich the end region of the shield electric wire 103 from outside of the end region, and the pair of holders 104*a*, 104*b* are fastened by the bolts 105 and nuts 106. An attachment portion 102*a* of the shield shell 102 is fixed to an earth member of a stationary side (not shown) to ground the shield shell 102 and the shield electric wire 103.

As illustrated in FIG. 2, a connector 120 of the second related art includes: a connector housing (not shown) from which an electric wire W connected to a terminal (not shown) is pulled out; a shield shell main body 122 fix to the outer periphery of the connector housing; a shield electric wire 123 disposed so as to cover the outer periphery of the electric wire W; an electric wire fastener 124 sandwiching the end region of the shield electric wire 123 from the outer periphery side of the end region; and a shield shell auxiliary member 125 to which the shield electric wire 123 is fastened by the electric wire fastener 124.

The assembling of the connector 120 of the second related art is performed in the following way. The end region of the shield electric wire 123 is fastened to the shield shell auxiliary member 125 by sandwiching the end region by the electric wire fastener 124. And then flanges 122*a*, 125*a* of the shield shell main body 122 and the shield shell auxiliary member 125 are faced each other, and the flanges 122*a*, 125*a* are fastened by bolts 126 and nuts 127. A fixation portion 122*b* of the shield shell main body 122 is fixed to an earth member of a stationary side (not shown) to ground the shield shell main body 122, the shield shell auxiliary member 125, and the shield electric wire 123.

SUMMARY OF THE INVENTION

However, the component count for the shield connection structures for the first and second related arts are twelve and eight in total respectively. It is also necessary for the shield connection structures for the first and second related arts to perform fastening operation of the bolts 105 and the nuts 106 and fastening operation of the bolts 126 and the nuts 127 respectively. The shield connection structures for the first and second related arts thus result in increased component count and poor assembling workability.

An object of the present invention is to provide a connector with both reduced component count for a shield connection structure and improved assembling workability.

An aspect of the present invention is a connector comprising: a first assembly structure including a connector housing from which an electric wire is pulled out, a first shield shell fixed to the connector housing and having a connection plate, and a first locking portion provided on any one of the connector housing and the first shield shell; and a second assembly structure assembled together with the first assembly structure, the second assembly structure including a second shield shell having a guide configured to make pressure contact with the connection plate of the first shield shell in an assembled state of the first assembly structure and the second assembly structure, a second locking portion configured to engage with the first locking portion of the first assembly structure in the assembled state, a shield electric wire configured to cover the electric wire, and an electric wire fastener configured to fasten the shield electric wire to the second shield shell from an outer side of the shield electric wire with the shield electric wire interposed between the electric wire fastener and the second shield shell.

The guide may have a pressure contact portion, and a guide side wall being perpendicular to a surface of the pressure contact portion and extending along an assembly direction in which the first assembly structure and the second assembly structure are assembled together with each other. The connection plate may have an elongate groove extending along the assembly direction and receiving the guide side wall in the elongate groove.

The first locking portion may be provided in the connector housing and the second locking portion may be provided in the second shield shell.

According to the above configuration, the component count for a shield connection structure for the connector is four in total, the first shield shell, the second shield shell, the electric wire fastener, and the shield electric wire. The assembling of the connector is easily and simply performed in the following way: the shield electric wire is fasten to the second shield shell by the electric wire fastener with the shield electric wire interposed between the electric wire fastener and the second shield shell to prepare the second assembly structure, and then the second assembly structure as prepared and the first assembly structure including the first shield shell fixed to the connector housing are assembled together with each other. The first and second assembly structures as assembled have the connection plate of the first shield shell and the guide of the second shield shell in pressure contact with each other to put the first and second assembly structures in a conduction state, and have the second locking portion and the first locking portion engaged with each other to hold the first and second assembly structures together. It is therefore possible to provide a connector with both reduced component count for a shield connection structure and improved assembling workability.

DETAILED DESCRIPTION OF THE EMBODIMENT

Figure 1:
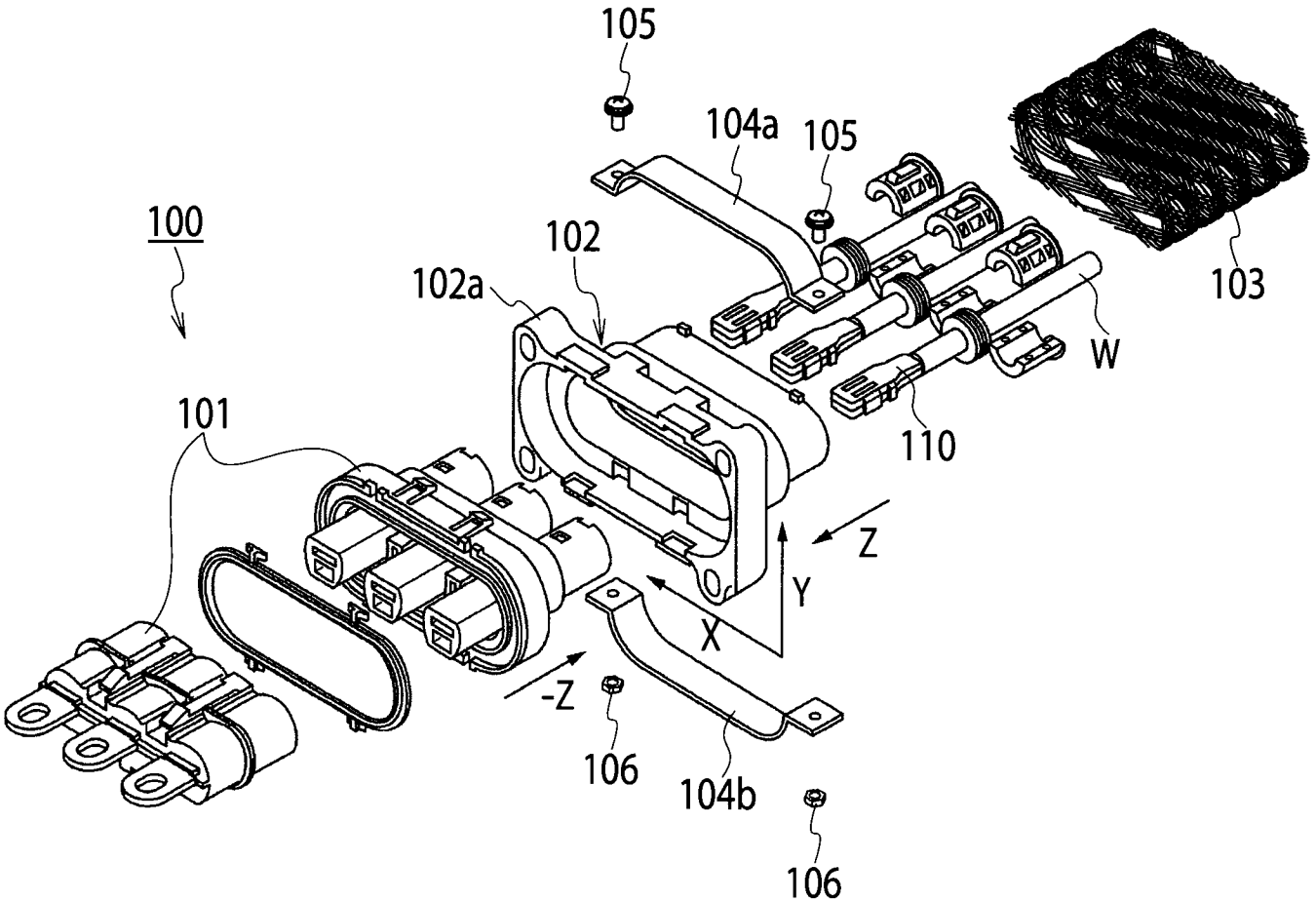
FIG. 1 is an exploded perspective view of a connector according to the first related art.
Figure 2:
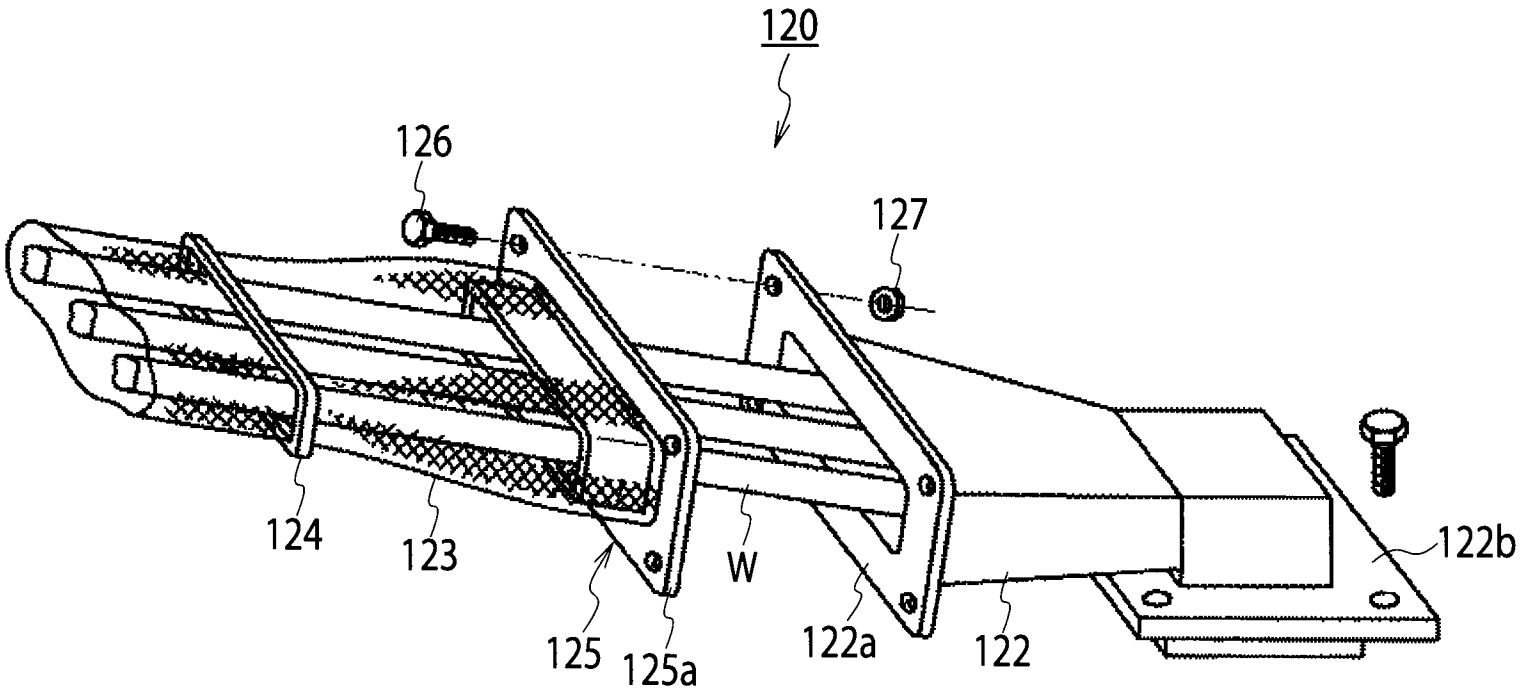
FIG. 2 is an exploded perspective view of a connector in an assembly process of a shield connection structure according to the second related art.
Figure 3:
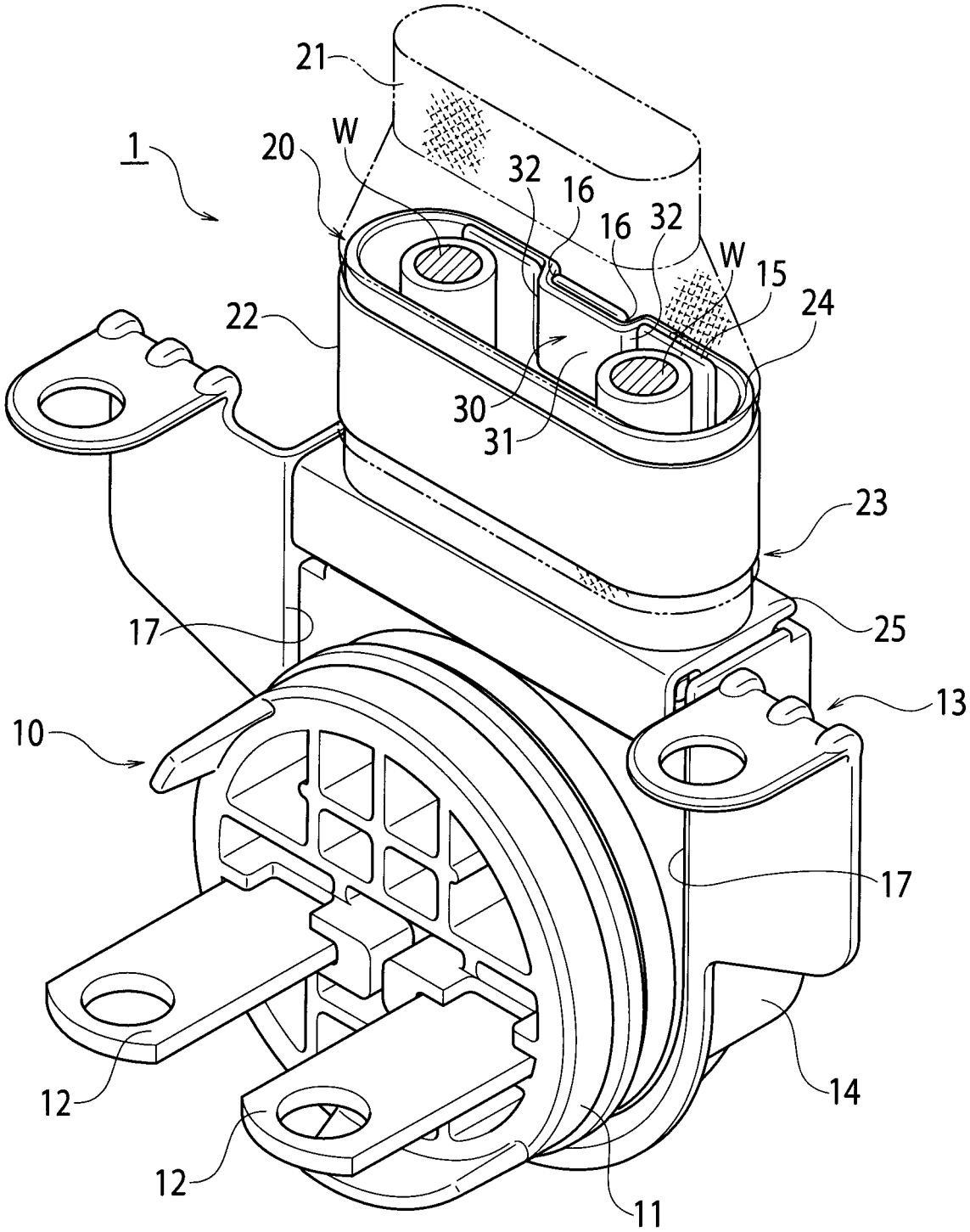
FIG. 3 is a perspective view of a connecter viewed from a projection side of a terminal according to an embodiment of the present invention.

Hereinbelow, an embodiment of the present invention will be described in detail by referring to the drawings.

FIGS. 3 to 7 illustrate a connector 1 according to an embodiment of the present invention. In FIGS. 3 to 7, the connector 1 is used for wire harnesses for HEVs and Evs. The connector 1 includes a first assembly structure 10 and a second assembly structure 20.

The first assembly structure 10 includes a connector housing 11 and a first shield shell 13 fixed to the connector housing 11. The connector housing 11 is formed of insulating synthetic resin. Two L-type terminals 12 are fixed to the connector housing 11. Tips of the terminals 12 protrude from the connector housing 11 respectively. The ends of electric wires W are connected to the root portions of the terminals 12 respectively. The two electric wires W are pulled out from the connector housing 11.

The first shield shell 13 is formed from a conductive metal plate. The first shield shell 13 includes: a shield shell main body 14 which covers the three surfaces other than the surface through which the terminals 12 of the connector housing 11 protrude; and a connection plate 15 which protrudes from the shield shell main body 14 toward a side in which the electric wires W are pulled out. The connection plate 15 has a pair of elongate grooves 16 extending along an assembly direction D. The pair of elongate grooves 16 open on the top surface of the connection plate 15 and divide the top portion of the connection plate 15 into three parts.

There are a pair of plate insertion space 17 between the both sides of the connector housing 11 and the inner surface of the shield shell main body 14. A pair of first locking portions 18 (see FIG. 5B) protrude into the pair of plate insertion space 17 respectively. The pair of first locking portions 18 are integrally formed with the connector housing 11.

The second assembly structure 20 includes: a second shield shell 23; a shield electric wire 21 which covers the electric wires W; and a shield ring 22 being an electric wire fastener which fastens the shield electric wire 21 to the second shield shell 23 with the shield electric wire 21 interposed between the electric wire fastener and the second shield shell 23. The shield ring 22 fastens (fixes) the end region of the shield electric wire 21 to the second shield shell 23.

The shield electric wire 21 is formed from conductive metal wires twisted together into a cylindrical shape. The shield ring 22 sandwiches the shield electric wire 21 with the outer periphery of the second shield shell 23 to bring the shield electric wire 21 in pressure contact with the outer periphery of the second shield shell 23.

The second shield shell 23 is formed from a conductive metal plate. The second shield shell 23 includes: a cylinder portion 24 having an approximately elliptically shaped cross-section; a slide regulation plate portion 25 which is integrally provided on the undersurface of the cylinder portion 24; and a pair of insertion plate portions 26 which vertically extend downward from the slide regulation plate portion 25. A guide 30 is integrally provided on the cylinder portion 24. The guide 30 is formed by folding a part of the cylinder portion 24, for example. The guide 30 includes: a pressure contact portion 31 which protrudes inward from the peripheral surface of the cylinder portion 24; and a pair of guide side walls 32 which are approximately perpendicular to the surface of the pressure contact portion 31 and extends along the assembly direction D. The guide 30 has, for example, a shape in which a central portion of the cylinder portion 24 is slightly distended inside the cylinder portion 24. This shape enables the pressure contact portion 31 to have spring property with respect to a direction perpendicular to the pressure contact portion 31. An insertion slit 33 is formed on the lower side of the pressure contact portion 31 and has a dimension corresponding to the difference in level between the pressure contact portion 31 and the cylinder portion 24.

A pair of second locking portions 27 are provided on the tips of the pair of insertion plate portions 26 respectively.

Next, the procedure for assembling the connector 1 is described. First, the first assembly structure 10 and the second assembly structure 20 are prepared. Specifically, the first shield shell 13 is fixed to the outer periphery of the connector housing 11 to prepare the first assembly structure 10. The end region of the shield electric wire 21 disposed so as to cover the electric wires W is disposed on the outer periphery of the second shield shell 23 and the shield ring 22 is attached to the second shield shell 23 from above of the shield electric wire 21 to prepare the second assembly structure 20.

Figure 4:
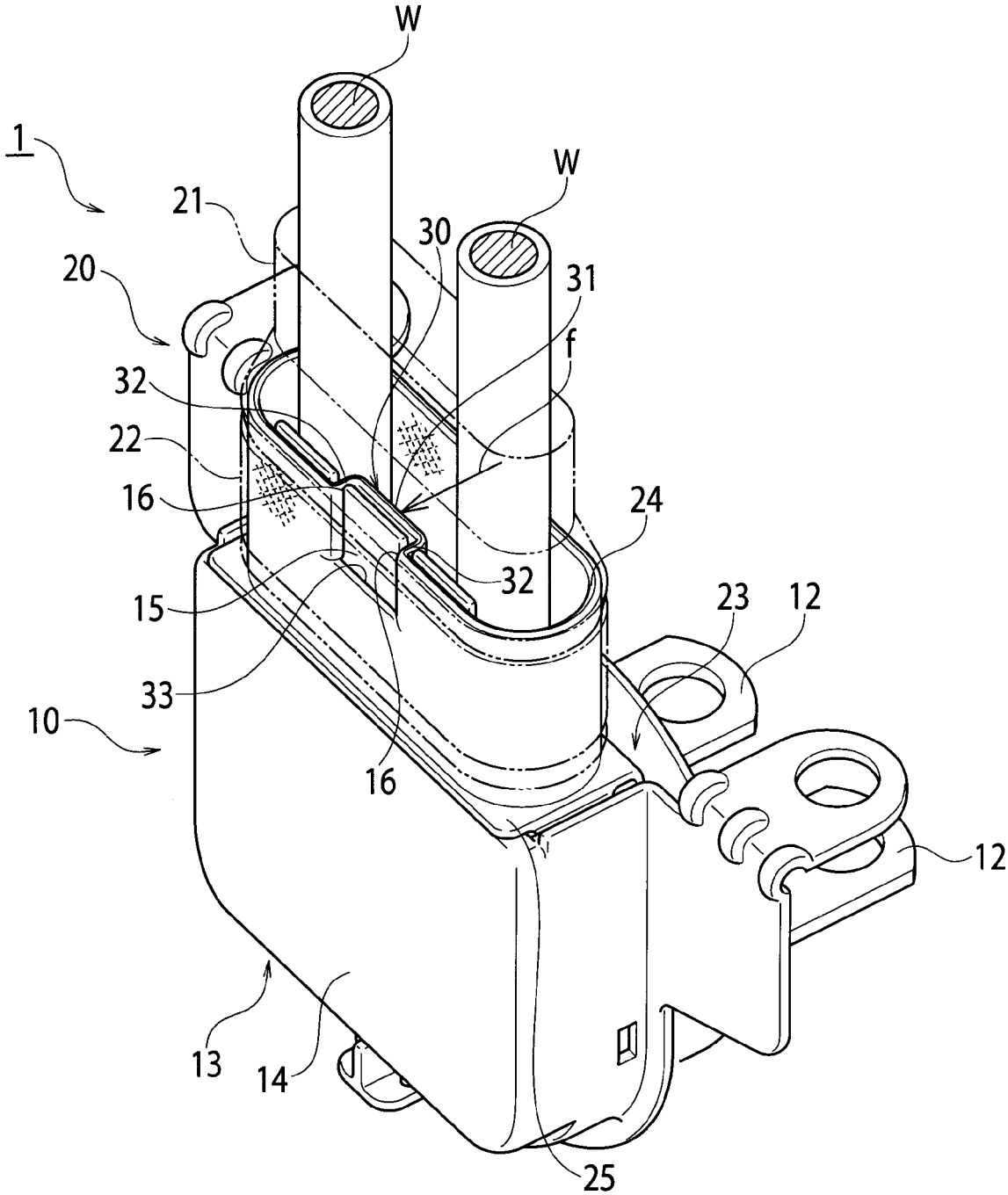
FIG. 4 is a perspective view of a connecter viewed from the opposite side of the projection side of the terminal according to the embodiment of the present invention.
Figure 5A:
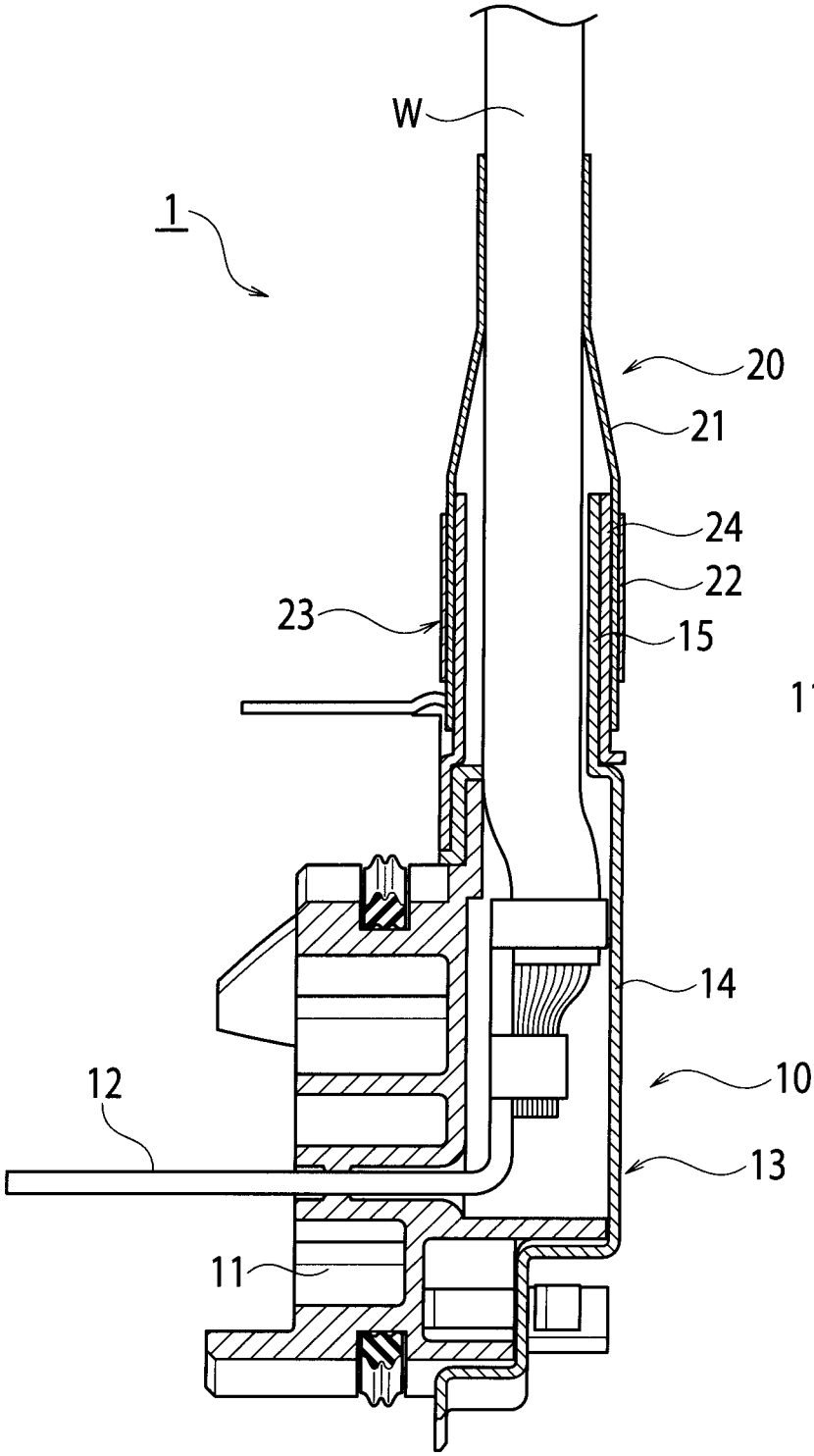
FIG. 5A is a cross-sectional view of the connector according to the embodiment of the present invention and FIG. 5B is a local cross-sectional view of the connector taken along a direction perpendicular to the cross-section of FIG. 5A.
Figure 5B:
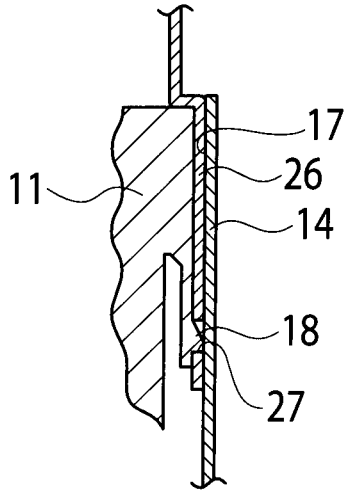
Figure 6:
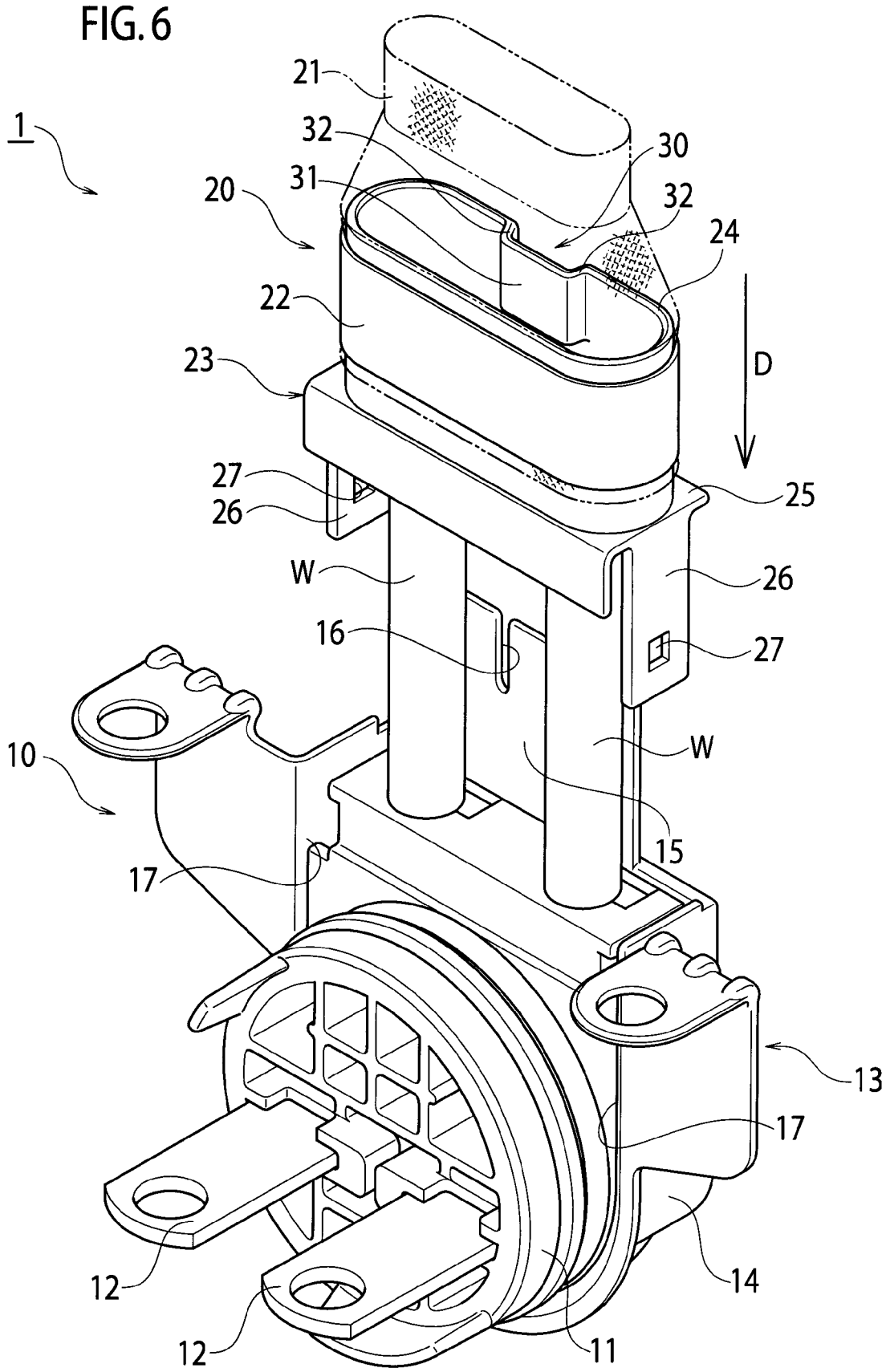
FIG. 6 is a perspective view of the connecter viewed from the projection side of the terminal in an assembly process of a shield connection structure according to the embodiment of the present invention.
Figure 7:
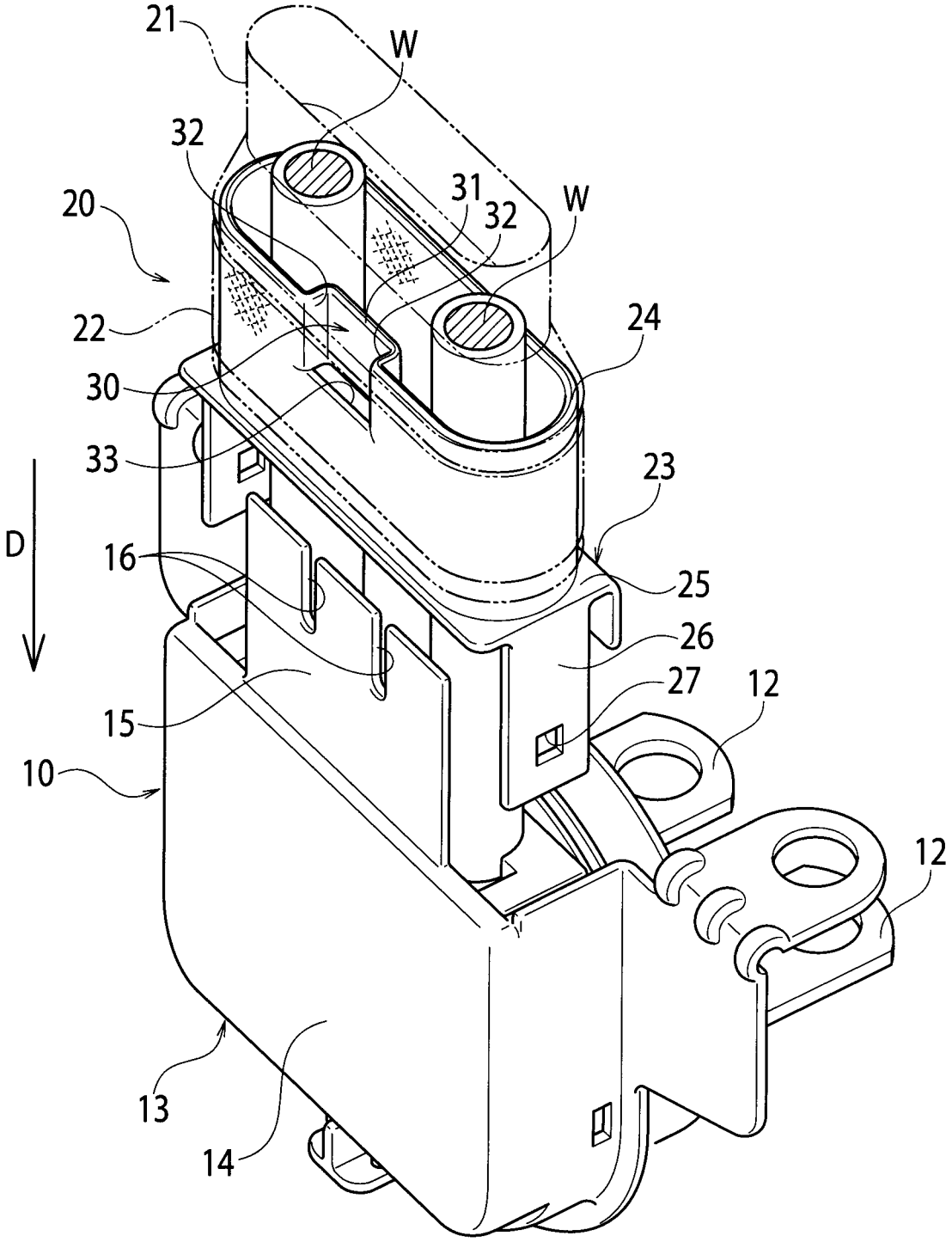
FIG. 7 is a perspective view of the connecter viewed from the opposite side of the projection side of the terminal in the assembly process of the shield connection structure according to the embodiment of the present invention.

Next, as illustrated in FIGS. 6 and 7, the second assembly structure 20 is moved in the assembly direction D for assembly with the first assembly structure 10. This movement results in the pair of insertion plate portions 26 of the second shield shell 23 inserted into the pair of plate insertion space 17 of the first assembly structure 10 respectively. In the process of this insertion, the pair of guide side walls 32 of the second shield shell 23 are inserted into the pair of elongated grooves 16 of the first shield shell 13. And then in the process, the connection plate 15 is pressed by the cylinder portion 24 in a direction of f arrow as illustrated in FIG. 4 due to the spring property of the pressure contact portion 31 of the guide 30, and the contacting surfaces of the cylinder portion 24 and the connection plate 15 are slid with the contacting surfaces being in contact with each other.

The pair of second locking portions 27 of the pair of insertion plate portions 26 are engaged with the pair of first locking portions 18 of the first assembly structure 10 when the second assembly structure 20 reaches an insertion completion position. The assembly operation is now completed.

As described above, the connector 1 includes the first assembly structure 10 and the second assembly structure 20. The first assembly structure 10 includes: the connector housing 11 having the first locking portions 18; and the first shield shell 13 which is fixed to the connector housing 11 and has a connection plate 15. The second assembly structure 20 includes: the second shield shell 23 which has the guide 30; the second locking portions 27 which engage with the first locking portions 18 of the first assembly structure 10 in the assembled state; the shield electric wire 21 which covers the electric wire W; and the shield ring 22 (the electric wire fastener) which fastens the shield electric wire 21 to the second shield shell 23 with the shield electric wire 21 interposed between the shield ring 22 and the second shield shell 23. Movement of the second assembly structure 20 and the first assembly structure 10 in the assembly direction results in the connection plate 15 of the first shield shell 13 and the cylinder portion 24 (including the guide 30) of the second shield shell 23 being in pressure contact with each other, and results in the second locking portions 27 of the second assembly structure 20 and the first locking portions 18 of the first assembly structure 10 being engaged with each other. Accordingly, the component count for a shield connection structure for the connector 1 is four in total, the first shield shell 13, the second shield shell 23, the shield ring 22, and the shield electric wire 21. The assembling of the connector 1 is easily and simply performed in the following way: the shield electric wire 21 is fasten to the second shield shell 23 by the shield ring 22 with the shield electric wire 21 interposed between the shield ring 22 and the second shield shell 23 to prepare the second assembly structure 20, and then the second assembly structure 20 as prepared and the first assembly structure 10 including the first shield shell 13 fixed to the connector housing 11 are assembled together with each other. The first assembly structure 10 and the second assembly structure 20 as assembled have the connection plate 15 of the first shield shell 13 and the cylinder portion 24 (including the guide 30) of the second shield shell 23 being in pressure contact with each other to put the first assembly structure 10 and the second assembly structure 20 in a conduction state, and have the second locking portions 27 and the first locking portions 18 engaged with each other to hold the first assembly structure 10 and the second assembly structure 20 together. Therefore the connector 1 requires reduced component count for the shield connection structure and has improved assembling workability.

In the insertion completion position, the undersurface of the slide regulation plate portion 25 of the second shield shell 23 is in contact with the upper surface of the shield shell main body 14 of the first shield shell 13, and the second locking portions 27 and the first locking portions 18 are engaged with each other. This positions the first shield shell 13 and the second shield shell 23 in the vertical direction.

The guide 30 includes: the pressure contact portion 31; and the guide side walls 32 which are approximately perpendicular to the pressure contact portion 31 and extends along the assembly direction D. The connection plate 15 has the elongate grooves 16 into which the guide side walls 32 are inserted and which extends along the assembly direction D. These configurations position the first shield shell 13 and the second shield shell 23 in the horizontal direction with respect to a direction in which the surface of the pressure contact portion 31 of the guide 30 faces and a direction perpendicular to the direction. In the present embodiment, the first shield shell 13 and the second shield shell 23 are therefore positioned both in the vertical direction and the horizontal direction.

According to the embodiment of the present invention, the pair of first locking portions 18 are provided on the connector housing 11. However, the pair of first locking portions 18 may be provided on the first shield shell 13.

The present invention is not limited to the above embodiment, and various modifications can be made on the basis of the gist of the present invention.

What is claimed is:

1. A connector comprising:

a first assembly structure including a connector housing from which an electric wire is pulled out, a first shield shell fixed to the connector housing and having a connection plate, and a first locking portion provided on any one of the connector housing and the first shield shell; and a second assembly structure assembled together with the first assembly structure, the second assembly structure including a second shield shell having a guide configured to make pressure contact with the connection plate of the first shield shell in an assembled state of the first assembly structure and the second assembly structure, a second locking portion configured to engage with the first locking portion of the first assembly structure in the assembled state, a shield electric wire configured to cover the electric wire, and an electric wire fastener configured to fasten the shield electric wire to the second shield shell from an outer side of the shield electric wire with the shield electric wire interposed between the electric wire fastener and the second shield shell.

2. The connector according to claim 1, wherein the guide has a pressure contact portion, and a guide side wall being perpendicular to a surface of the pressure contact portion and extending along an assembly direction in which the first assembly structure and the second assembly structure are assembled together with each other, and the connection plate has an elongate groove extending along the assembly direction and receiving the guide side wall in the elongate groove.

3. The connector according to claim 1, wherein the first locking portion is provided in the connector housing, and the second locking portion is provided in the second shield shell.

* * * * *